US010099095B2

(12) United States Patent
Myers

(10) Patent No.: US 10,099,095 B2
(45) **Date of Patent: *Oct. 16, 2018**

(54) GOLF CLUB HEAD WITH ADJUSTABLE CENTER OF GRAVITY

(71) Applicant: Callaway Golf Company, Carlsbad, CA (US)

(72) Inventor: Matthew Myers, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/665,166

(22) Filed: Jul. 31, 2017

(65) Prior Publication Data

US 2017/0326421 A1 Nov. 16, 2017

Related U.S. Application Data

(63) Continuation of application No. 15/018,040, filed on Feb. 8, 2016, now Pat. No. 9,731,178, which is a (Continued)

(51) Int. Cl.
*A63B 53/04* (2015.01)
*A63B 53/06* (2015.01)
(Continued)

(52) U.S. Cl.
CPC ..... *A63B 53/06* (2013.01); *A63B 53/047* (2013.01); *A63B 53/0466* (2013.01);
(Continued)

(58) Field of Classification Search
USPC ..... 473/324–350
See application file for complete search history.

(56) References Cited

U.S. PATENT DOCUMENTS 5,683,309 A * 11/1997 Reimers ..... A63B 53/04 473/337
6,890,267 B2 * 5/2005 Mahaffey ..... A63B 53/0466 473/256
(Continued)

FOREIGN PATENT DOCUMENTS

JP 01043278 A * 2/1989
JP 2005296582 A * 10/2005
(Continued)

*Primary Examiner* — Alvin Hunter
(74) *Attorney, Agent, or Firm* — Rebecca Hanovice; Michael Catania; Sonia Lari

(57) ABSTRACT

A golf club head comprising a slidable weight for adjusting the location of the club head center of gravity is disclosed herein. The club head has an S-shaped channel disposed in its sole and a slidable weight assembly comprising a retention plate, at least one bolt, and a weighted base. The weighted base comprises at least one spherical portion extending from its underside to permit the slidable weight assembly to slide smoothly within the channel, which preferably has a partially tubular cross-section along a vertical Z-axis. The bolt, when tightened, reversibly fixes the slidable weight assembly to a pair of rails extending into the channel from the channel's walls.

20 Claims, 5 Drawing Sheets

Related U.S. Application Data continuation-in-part of application No. 14/175,657, filed on Feb. 7, 2014, now Pat. No. 9,364,728, and a continuation-in-part of application No. 14/174,068, filed on Feb. 6, 2014, now Pat. No. 9,289,660, which is a continuation-in-part of application No. 14/163,946, filed on Jan. 24, 2014, now Pat. No. 9,211,453, which is a continuation-in-part of application No. 14/033,218, filed on Sep. 20, 2013, now Pat. No. 8,696,491, which is a continuation-in-part of application No. 13/923,571, filed on Jun. 21, 2013, now Pat. No. 9,084,921, which is a continuation-in-part of application No. 13/778,958, filed on Feb. 27, 2013, now Pat. No. 8,894,506, said application No. 14/163,946 is a continuation-in-part of application No. 13/766,658, filed on Feb. 13, 2013, now Pat. No. 8,790,195.

(60) Provisional application No. 61/905,749, filed on Nov. 18, 2013, provisional application No. 61/898,956, filed on Nov. 1, 2013, provisional application No. 61/893,728, filed on Oct. 21, 2013, provisional application No. 61/727,608, filed on Nov. 16, 2012, provisional application No. 61/746,348, filed on Dec. 27, 2012.

(51) Int. Cl.
*A63B 60/52* (2015.01)
*A63B 60/02* (2015.01)

(52) U.S. Cl.
CPC ..... *A63B 60/02* (2015.10); *A63B 60/52* (2015.10); *A63B 2053/0433* (2013.01); *A63B 2053/0491* (2013.01)

(56) References Cited

U.S. PATENT DOCUMENTS 7,128,662 B2 * 10/2006 Kumamoto ..... A63B 53/0466 473/345
7,147,573 B2 * 12/2006 DiMarco ..... A63B 53/0466 473/324
7,166,041 B2 * 1/2007 Evans ..... A63B 53/0466 473/334
7,452,286 B2 * 11/2008 Lin ..... A63B 53/0466 473/334
7,611,424 B2 * 11/2009 Nagai ..... A63B 53/0466 473/334
7,704,163 B2 * 4/2010 Stites ..... A63B 53/047 473/334
7,775,905 B2 * 8/2010 Beach ..... A63B 53/0466 473/256
7,806,782 B2 * 10/2010 Stites ..... A63B 53/0466 473/334
7,824,280 B2 * 11/2010 Yokota ..... A63B 53/04 473/334
8,016,694 B2 * 9/2011 Llewellyn ..... A63B 53/0466 473/334
8,192,303 B2 * 6/2012 Ban ..... A63B 53/0466 473/335
8,202,175 B2 * 6/2012 Ban ..... A63B 53/0466 473/334
8,206,243 B2 * 6/2012 Stites ..... A63B 53/0466 473/334
8,262,495 B2 * 9/2012 Stites ..... A63B 53/047 473/226
8,444,505 B2 * 5/2013 Beach ..... A63B 53/0466 473/334
8,696,491 B1 * 4/2014 Myers ..... A63B 53/0466 473/334
8,790,195 B1 * 7/2014 Myers ..... A63B 53/0466 473/335
8,821,307 B2 * 9/2014 Park ..... A63B 53/04 473/244
8,894,506 B1 * 11/2014 Myers ..... A63B 53/0466 473/334
8,968,116 B1 * 3/2015 Myers ..... A63B 53/0466 473/338
9,101,811 B1 * 8/2015 Goudarzi ..... A63B 53/0466
9,731,178 B1 * 8/2017 Myers ..... A63B 53/06
9,776,060 B2 * 10/2017 Hall ..... A63B 53/06
9,849,359 B2 * 12/2017 Gibbs ..... A63B 53/06
2006/0122004 A1 * 6/2006 Chen ..... A63B 53/0466 473/335
2006/0178228 A1 * 8/2006 DiMarco ..... A63B 53/0466 473/334
2006/0240908 A1 * 10/2006 Adams ..... A63B 53/0466 473/334
2008/0020861 A1 * 1/2008 Adams ..... A63B 53/04 473/334
2008/0261715 A1 * 10/2008 Carter ..... A63B 53/0466 473/291
2010/0075773 A1 * 3/2010 Casati, Jr. ..... A63B 49/02 473/334
2011/0053705 A1 * 3/2011 Stites ..... A63B 53/0466 473/334
2015/0321055 A1 * 11/2015 Golden ..... A63B 53/0466 473/338

FOREIGN PATENT DOCUMENTS

JP 2005323978 A * 11/2005
JP 2006320493 A * 11/2006
JP 2008086337 A * 4/2008
JP 2010252964 A * 11/2010
JP 2011010722 A * 1/2011
JP 2014111170 A * 6/2014 ..... A63B 53/0466
WO WO 2007044220 A1 * 4/2007 ..... A63B 53/06

* cited by examiner

GOLF CLUB HEAD WITH ADJUSTABLE CENTER OF GRAVITY

CROSS REFERENCES TO RELATED APPLICATIONS

The present application is a continuation of U.S. patent application Ser. No. 15/018,040, filed on Feb. 8, 2016, and issued on Aug. 15, 2017, as U.S. Pat. No. 9,731,178, which is a continuation-in-part of U.S. patent application Ser. No. 14/175,657, filed on Feb. 7, 2014, and issued on Jun. 14, 2016, as U.S. Pat. No. 9,364,728, which claims priority to U.S. Provisional Patent Application No. 61/905,749, filed on Nov. 18, 2013, 61/898,956, filed on Nov. 1, 2013, and 61/893,728, filed on Oct. 21, 2013, and is a continuation-in-part of U.S. patent application Ser. No. 14/174,068, filed on Feb. 6, 2014, and issued on Mar. 22, 2016, as U.S. Pat. No. 9,289,660, which is a continuation-in-part of U.S. patent application Ser. No. 14/163,946, filed on Jan. 24, 2014, and issued on Dec. 15, 2015, as U.S. Pat. No. 9,211,453, which is a continuation-in-part of U.S. patent application Ser. No. 14/033,218, filed on Sep. 20, 2013, and issued on Apr. 15, 2014, as U.S. Pat. No. 8,696,491, which is a continuation-in-part of U.S. patent application Ser. No. 13/923,571, filed on Jun. 21, 2013, and issued on Jul. 21, 2015, as U.S. Pat. No. 9,084,921, which is a continuation-in-part of U.S. patent application Ser. No. 13/778,958, filed on Feb. 27, 2013, and issued on Nov. 25, 2014, as U.S. Pat. No. 8,894,506, which claims priority to U.S. Provisional Patent Application No. 61/727,608, filed on Nov. 16, 2012, the disclosure of each of which is hereby incorporated by reference in its entirety herein. U.S. patent application Ser. No. 14/163,946 also is a continuation-in-part of U.S. patent application Ser. No. 13/766,658, filed on Feb. 13, 2013, and issued on Jul. 29, 2014, as U.S. Pat. No. 8,790,195, which claims priority to U.S. Provisional Patent Application No. 61/746,348, filed on Dec. 27, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a weight for a golf club head that can be adjusted along one or more channels.

Description of the Related Art

The ability to adjust center of gravity location and weight in the head of driving clubs is useful for controlling performance of the golf club. The prior art includes several different solutions for adjustable weighting, but these solutions do not optimize weight adjustment. There is a need for a weighting mechanism that allows for simple and flexible center of gravity (CG) and moment of inertia (MOI) adjustability.

BRIEF SUMMARY OF THE INVENTION

The present invention presents a novel way of working with adjustable products. The present invention allows consumers to easily move and fix a weight at any location within one or more channels disposed in the golf club head in such a way to maximize aesthetic appearances while preserving the function of the movable weight. The objective of this invention is to provide an adjustable weight with minimal or no effect on appearance at address while maximizing the ability of the weight to adjust center of gravity location. Additional goals include minimizing the fixed component of the structure dedicated to the weighting system and also minimizing any potential effect on impact sound.

One aspect of the present invention is a golf club head comprising a body comprising a hosel, a striking face, a heel side, a toe side, a rear side, a sole, and a channel in the sole, and a slidable weight assembly comprising a retention plate, a weighted base, and at least one bolt having a head portion and a threaded extension portion, wherein the channel comprises a curved floor, a first wall, a second wall, a first rail extending from the first wall, and a second rail extending from the second wall, wherein the channel comprises a first length, wherein the first and second rails each comprise a second length, wherein the first length is greater than the second length, wherein the retention plate comprises a first lower surface, at least one first through-bore, and at least one ledge having a second lower surface that is offset from the first lower surface, wherein the weighted base comprises an upper surface, at least one threaded bore, and at least one spherical portion centered around the at least one threaded bore, wherein the head portion rests against the at least one ledge within the first through-bore when the bolt is engaged with the retention plate, wherein the threaded extension portion is sized to engage the at least one threaded bore, wherein the bolt reversibly fixes the slidable weight to the rails, and wherein the retention plate does not make contact with the weighted base when the slidable weight assembly is fixed within the channel.

In some embodiments, the at least one threaded bore may comprise first and second threaded bores, the at least one spherical portion may comprise first and second spherical portions, the first spherical portion may be centered around the first threaded bore, and the second spherical portion may be centered around the second threaded bore. In other embodiments, the hosel may comprise a second through-bore, which may communicate with the channel in the sole. In any of the embodiments disclosed herein, the channel may be S-shaped. In some embodiments, the golf club head may be selected from the group consisting of a driver-type head, a fairway wood-type head, and a hybrid-type head. In other embodiments, the channel may extend from the heel side to the toe side and from a location proximate the striking face to a location proximate the rear side. In some embodiments, each of the first and second rail may be angled towards the sole with respect to the curved floor of the channel. In other embodiments, the channel may have a cross-section along a vertical Z axis that is partially tubular in shape.

In some embodiments, the golf club head of claim may comprise a composite crown, and the body may be composed of a metal alloy, which may be selected from the group consisting of titanium alloy and steel. In some embodiments, the slidable weight assembly may be approximately oval in shape, the weighted base may be composed of a first material having a first density, the retention plate may be composed of a second material having a second density, and the first density may be greater than the second density. In a further embodiment, the first material may be a tungsten alloy and the second material may be stainless steel. In yet another embodiment, the slidable weight assembly may comprise a receiving opening between the first lower surface of the retention plate and the upper surface of the weighted base, and the receiving opening may be sized to receive at least a portion of the first and second rails.

Another aspect of the present invention is a wood-type golf club head comprising a metal body comprising a hosel, a striking face, a heel side, a toe side, a rear side, a sole, and an S-shaped channel in the sole, a composite crown, and an oval-shaped slidable weight assembly comprising a retention plate, a weighted base, and at least one bolt having a head portion and a threaded extension portion, wherein the channel comprises a curved floor, a first wall, a second wall, a first rail extending from the first wall at an angle with respect to the curved floor, and a second rail extending from the second wall at an angle with respect to the curved floor, wherein the weighted base comprises at least one threaded bore and at least one spherical portion centered around the at least one threaded bore, wherein the retention plate comprises at least one first through-bore, wherein the hosel comprises a second through-bore, wherein the second through-bore communicates with the channel in the sole, wherein the threaded extension portion is sized to engage the at least one threaded bore, wherein the bolt reversibly fixes the slidable weight to the rails, and wherein the retention plate does not make contact with the weighted base when the slidable weight assembly is fixed within the channel.

In some embodiments, the at least one threaded bore may comprise first and second threaded bores, the at least one spherical portion may comprise first and second spherical portions, the first spherical portion may be centered around the first threaded bore, and the second spherical portion may be centered around the second threaded bore. In other embodiments, the weighted base may be composed of a first material having a first density, the retention plate may be composed of a second material having a second density, and the first density may be greater than the second density. In a further embodiment, the first material may be a tungsten alloy and the second material may be stainless steel. In yet another embodiment, a first portion of the channel may extend from the heel side to the toe side, a second portion of the channel may extend from the toe side towards the rear side, a third portion of the channel may extend from a location proximate the rear side towards the striking surface, and a fourth portion of the channel may extend from a location proximate the heel side towards the rear side. In another embodiment, the channel may comprise a first length, the first and second rails each may comprise a second length, and the first length may be greater than the second length.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
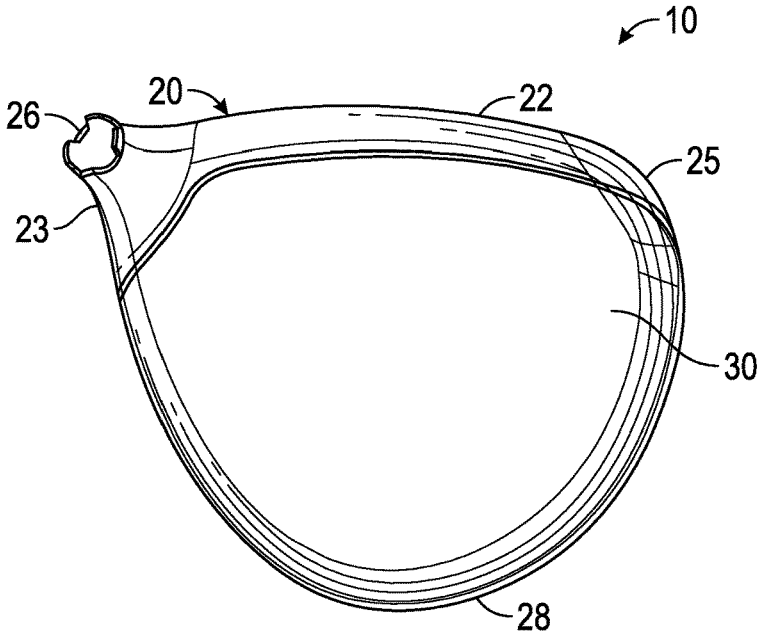
FIG. 1 is a top plan view of a golf club head of the present invention.

The design approaches described herein are based on a construction used in a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup. The embodiments may also work in conjunction with at least one adjustable weight port on the club head. Shifting weight along the channel described herein allows for control of center of gravity location and adjustment of other mass properties.

A preferred embodiment of the present invention is shown in FIGS. 1-8. The golf club head 10, which preferably is a driver or a large fairway wood, comprises a body 20 having a face 22, a heel side 23 proximate a hosel 26, a toe side 25, a rear edge 28, a sole 40, and an upper opening (not shown) that is covered by a separately formed crown 30. The hosel 26 has a through-bore 27 that extends into the sole 40 and connects with an elongated, S-shaped channel 50. The hosel 26 preferably has a structure that permits loft, lie, and face angle adjustability, including any of the structures disclosed in U.S. Pat. Nos. 8,641,554, 8,684,859, 8,696,486, 8,715,103, 8,715,104, 8,727,906, and 8,801,537, the disclosure of each of which is hereby incorporated by reference in its entirety herein.

Figure 2:
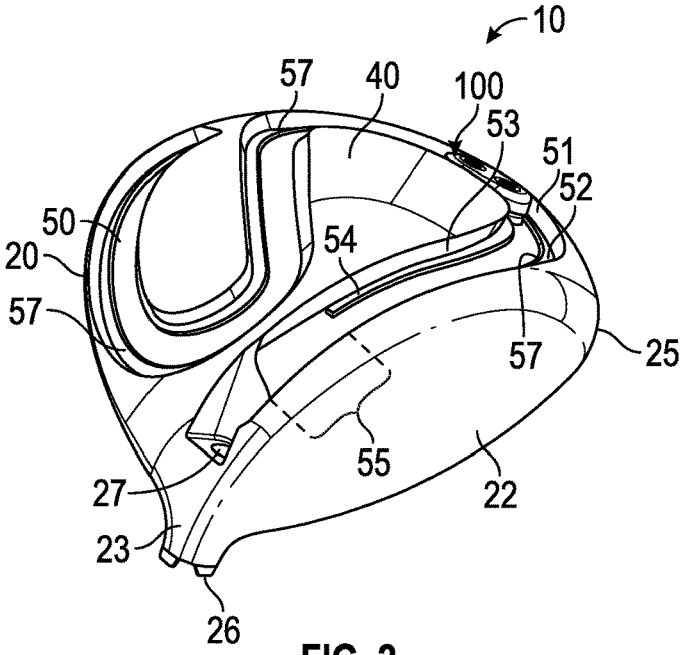
FIG. 2 is a sole perspective view of the embodiment shown in FIG. 1.
Figure 3:
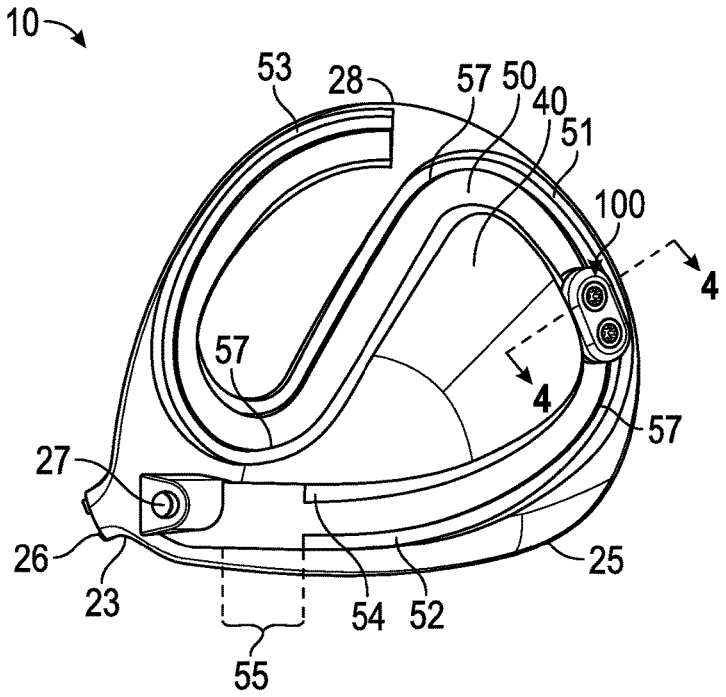
FIG. 3 is a sole elevational view of the embodiment shown in FIG. 1.

As shown in FIGS. 2 and 3, the channel 50 extends from the heel side 23 to the toe side 25 and then doubles back across the sole 40, though in alternative embodiments the channel 50 may extend onto a ribbon or skirt portion or even onto the crown 30 of the golf club head 10. The S-shape of the channel 50 allows the weight to be moved along both the Y axis (heel side 23 to toe side 25) and the X axis (face 22 to rear edge 28) without having multiple channels—in other words, the single channel 50 of the present invention allows for greater mass property, and particularly center of gravity, adjustability than other club heads having only a single channel 50. If the channel 50 extends onto the ribbon or crown 30, then the mass properties of the club head 10 can be adjusted along the vertical Z axis as well.

Figure 4:
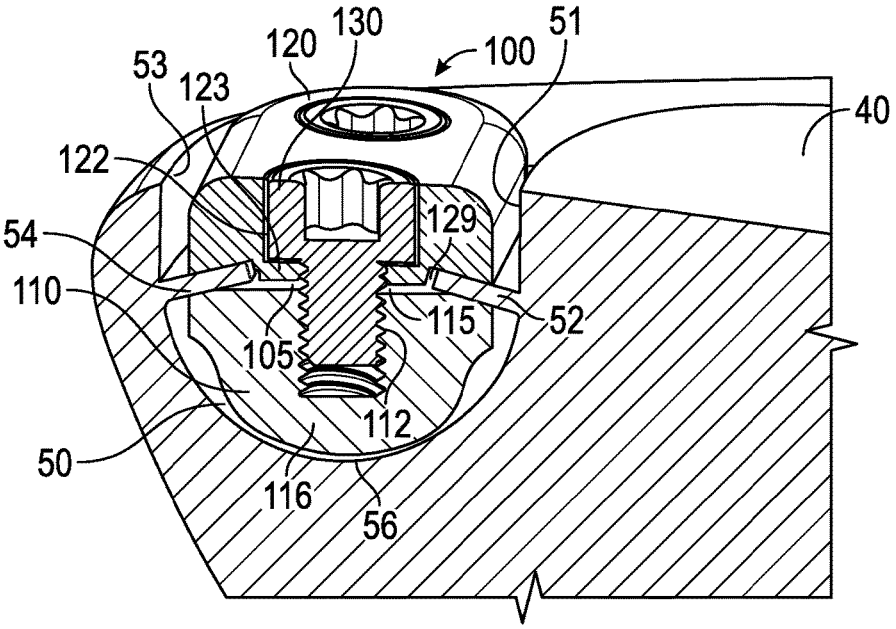
FIG. 4 is a cross-sectional view of the embodiment shown in FIG. 3 along lines 4-4.
Figure 5:
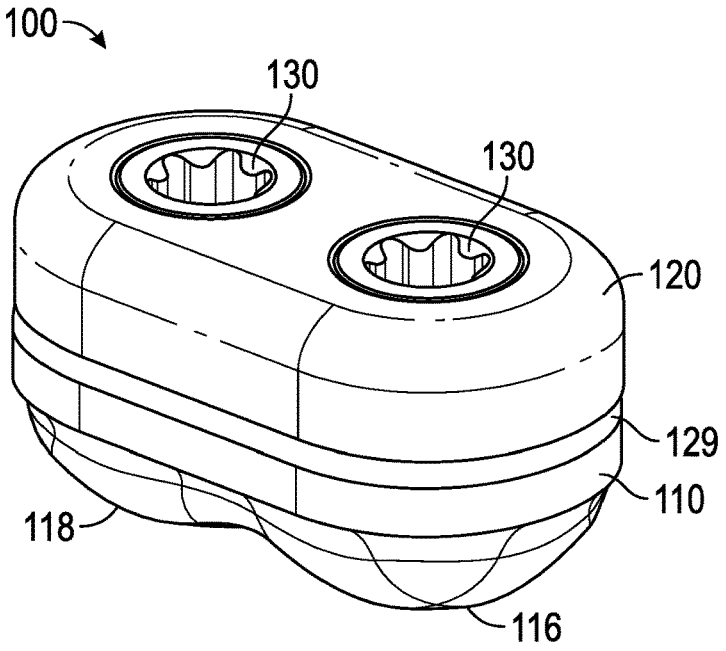
FIG. 5 is a perspective view of the slidable weight shown in FIGS. 2-4.
Figure 6:
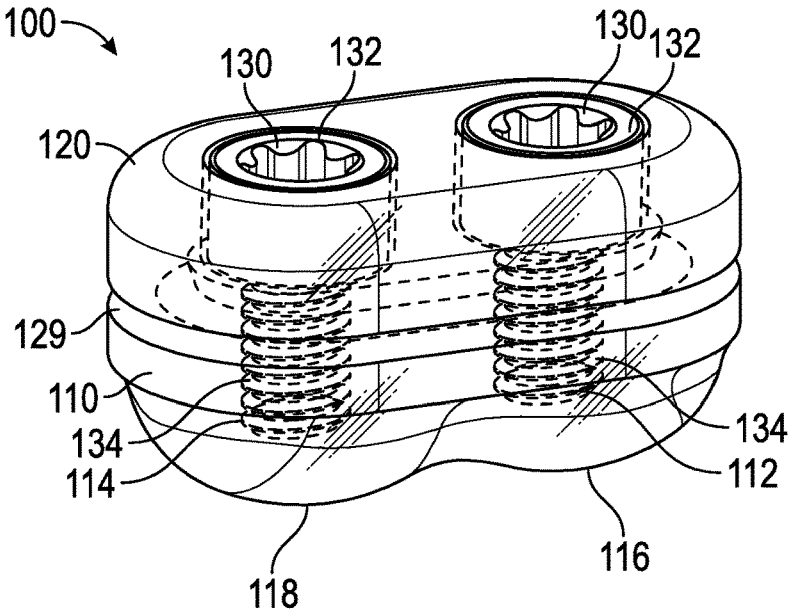
FIG. 6 is a partially translucent view of the slidable weight shown in FIG. 5.
Figure 7:
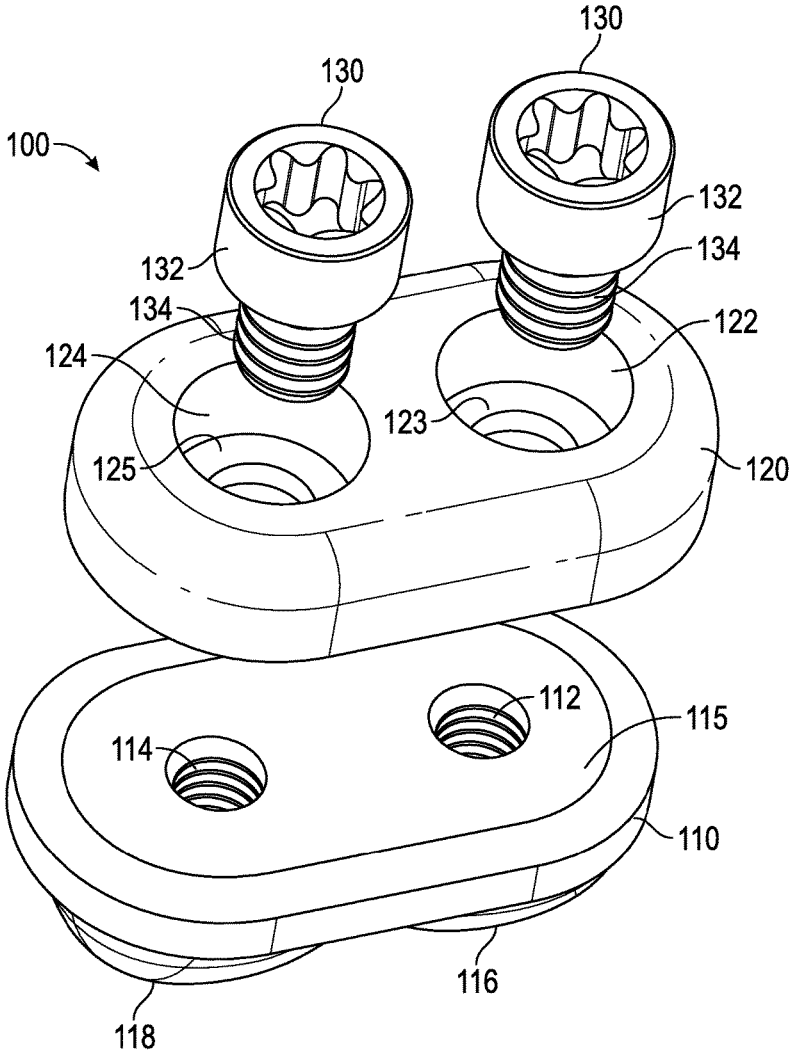
FIG. 7 is an exploded view of the slidable weight shown in FIG. 5.

The channel 50 includes a pair of rails 52, 54 that extend away from the side walls 51, 53 of the channel 50 parallel to one another. The rails 52, 54 terminate less than 1 inch from the end of the channel 50 to form an open area 55 located proximate the through-bore 27, thereby creating an entry region where a slidable weight assembly 100 can be inserted into the channel 50. In an alternative embodiment, however, the rails 52, 54 may extend the entire length of the channel 50 and the slidable weight assembly 100 can be inserted piecemeal into the channel 50. As shown in FIG. 4, the channel 50 has a smoothly rounded cross-section, such that it is partially tubular in shape, and the rails 52, 54 are angled slightly towards the sole 40 with respect to the rounded floor 56 of the channel 50.

Figure 8:
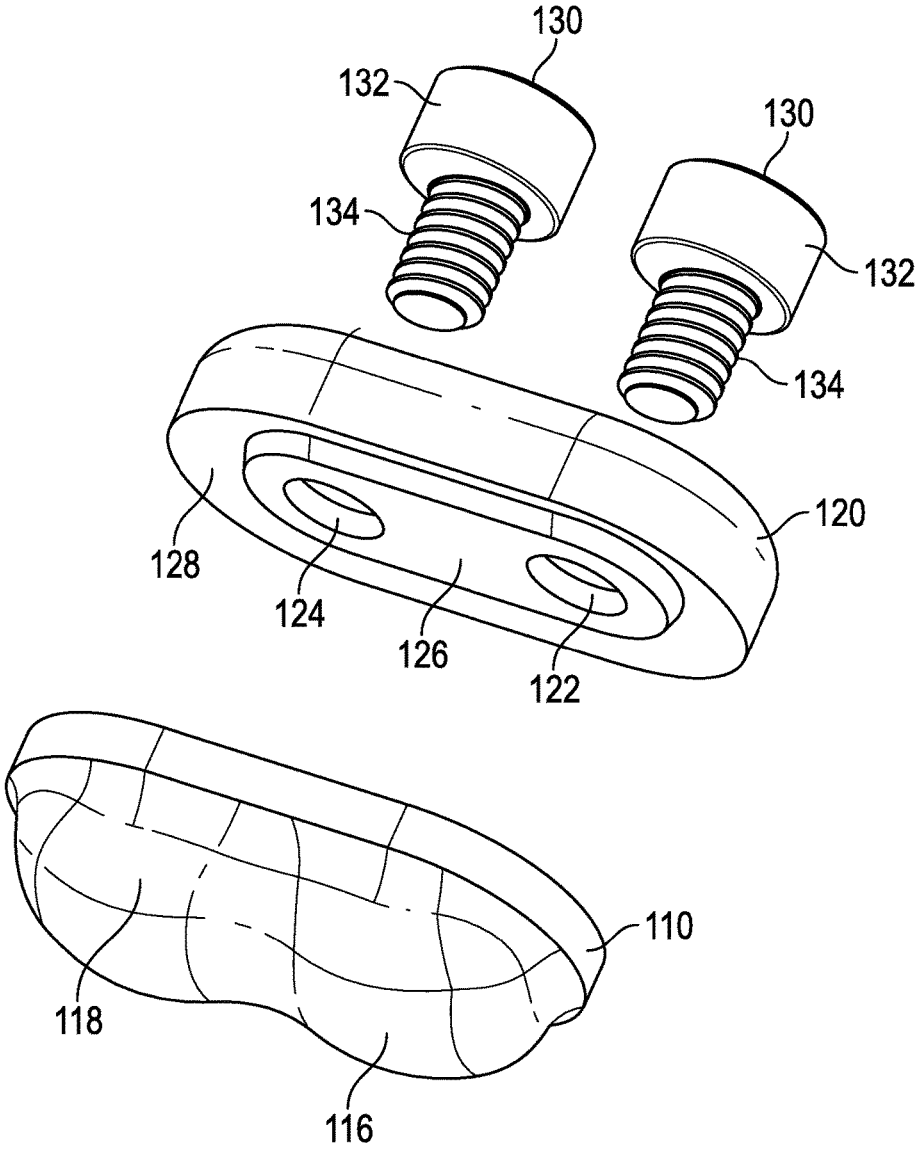
FIG. 8 is another exploded view of the slidable weight shown in FIG. 5.

The slidable weight assembly 100 of the present invention is unique in its curvature and shape. As shown in FIGS. 4-8, the slidable weight assembly 100 has an approximately oval shape and includes a weighted base 110 with two threaded bores 112, 114 and two spherical portions 116, 118 disposed around the threaded bores 112, 114. The spherical portions 116, 118 approximate the curvature of the channel 50 to allow the slidable weight assembly 100 to glide easily within the channel 50 during adjustment without getting snagged in the channel 50 at corners 57 where the channel 50 doubles back across the sole 40. The slidable weight assembly 100 also includes pair of bolts 130, each having a head portion 132 and a threaded extension portion 134, and a retention plate 120 with two through-bores 122, 124, each including a ledge 123, 125 against which the head portion 132 abuts when the threaded extension portions 134 are fully engaged with the threaded bores 112, 114 of the weighted base 110. As shown in FIG. 8, the ledges 123, 125 preferably form a ledge lower surface 126 that is offset from a main lower surface 128 of the retention plate 120. This offset feature creates a receiving opening 129 where the rails 52, 54 can fit between the retention plate 120 and the weighted base 110, so that the bolts 130 need only be loosened a small amount to allow the slidable weight assembly 100 to move along the rails 52, 54.

Once the slidable weight assembly 100 has been moved to a desired location on the rails 52, 54 within the channel 50, the slidable weight assembly 100 is semi-permanently fixed in place with the bolts 130, which pull the retention plate 120 and weighted base 110 towards each other, thus creating a clamping force on the rails 52, 54. Preferably, as shown in FIG. 4, neither the lower ledge surface 126 or the main lower surface 128 of the retention plate 120 makes contact with an upper surface 115 of the weighted base 110, such that there is a small gap 105 between these two pieces when the bolts 130 are fully tightened within the threaded bores 112, 114. This spacing prevents the retention plate 120 from ratting against the weighted base 110 when the golf club head 10 is in use.

In the first and second embodiments disclosed herein, the body 20 of the golf club head 10 preferably is formed from a metal material, while the crown 30 is formed from a non-metal material such as composite. In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A golf club head comprising:

a body comprising a hosel, a striking face, a heel side, a toe side, a rear side, a sole, and a channel in the sole; and a slidable weight assembly comprising a retention plate, a weighted base, and at least one bolt having a head portion and a threaded extension portion, wherein the channel comprises a curved floor, a first wall, a second wall, a first rail extending from the first wall, and a second rail extending from the second wall, wherein the retention plate comprises a first lower surface, at least one first through-bore, and at least one ledge having a second lower surface that is offset from the first lower surface, wherein the weighted base comprises an upper surface, at least one threaded bore, and at least one convex spherical portion centered around the at least one threaded bore, wherein the at least one convex spherical portion has the same approximate curvature as the channel, wherein the head portion rests against the at least one ledge within the first through-bore when the bolt is engaged with the retention plate, wherein the threaded extension portion is sized to engage the at least one threaded bore, wherein the bolt reversibly fixes the slidable weight to the rails, and wherein the retention plate does not make contact with the weighted base when the slidable weight assembly is fixed within the channel.

2. The golf club head of claim 1, wherein the at least one threaded bore comprises first and second threaded bores, wherein the at least one convex spherical portion comprises first and second convex spherical portions, wherein the first convex spherical portion is centered around the first threaded bore, and wherein the second convex spherical portion is centered around the second threaded bore.

3. The golf club head of claim 1, wherein the hosel comprises a second through-bore, and wherein the second through-bore communicates with the channel in the sole.

4. The golf club head of claim 1, wherein the channel is S-shaped.

5. The golf club head of claim 1, wherein the golf club head is selected from the group consisting of a driver-type head, a fairway wood-type head, and a hybrid-type head.

6. The golf club head of claim 1, wherein the channel extends from the heel side to the toe side and from a location proximate the striking face to a location proximate the rear side.

7. The golf club head of claim 1, wherein each of the first and second rails is angled towards the sole with respect to the curved floor of the channel.

8. The golf club head of claim 1, wherein the channel has a cross-section along a vertical Z axis that is partially tubular in shape.

9. The golf club head of claim 1, further comprising a composite crown, wherein the body is composed of a metal alloy.

10. The golf club head of claim 9, wherein the metal alloy is selected from the group consisting of titanium alloy and steel.

11. The golf club head of claim 1, wherein the slidable weight assembly is approximately oval in shape.

12. The golf club head of claim 1, wherein the weighted base is composed of a first material having a first density, wherein the retention plate is composed of a second material having a second density, and wherein the first density is greater than the second density.

13. The golf club head of claim 12, wherein the first material is a tungsten alloy and wherein the second material is stainless steel.

14. The golf club head of claim 1, wherein the slidable weight assembly comprises a receiving opening between the first lower surface of the retention plate and the upper surface of the weighted base, and wherein the receiving opening is sized to receive at least a portion of the first and second rails.

15. The golf club head of claim 1, wherein the channel comprises a first length, wherein the first and second rails each comprise a second length, and wherein the first length is greater than the second length.

16. A weight assembly comprising:

a retention plate comprising a first lower surface, a first unthreaded through-bore, a second unthreaded through-bore, a first ledge extending beneath the first unthreaded through-bore, and a second ledge extending beneath the second unthreaded through-bore, each of the first and second ledges having a second lower surface that is vertically offset from the first lower surface;

a weighted base comprising an upper surface, a first threaded bore, a second threaded bore, a first convex spherical portion centered around the first threaded bore, and a second convex spherical portion centered around the second threaded bore; and at least one bolt having a head portion and a threaded extension portion, wherein the head portion rests against one of the first and second ledges when the at least one bolt is engaged with the retention plate, wherein the threaded extension portion is sized to engage one of the first and second threaded bores, and wherein the weight assembly is approximately oval in shape.

17. The weight assembly of claim 16, wherein the weighted base is composed of a first material having a first density, wherein the retention plate is composed of a second material having a second density, and wherein the first density is greater than the second density.

18. The weight assembly of claim 17, wherein the weighted base is composed of a tungsten alloy, and wherein the retention plate is composed of stainless steel.

19. The weight assembly of claim 16, wherein the at least one bolt comprises a first bolt with a first head portion and a first threaded extension portion and a second bolt with a second head portion and a second threaded extension portion, wherein the first threaded extension portion extends through the first unthreaded through-bore to engage the first threaded bore, and wherein the second threaded extension portion extends through the second unthreaded through-bore to engage the second threaded bore.

20. The weight assembly of claim 16, further comprising a receiving opening disposed between the first lower surface of the retention plate and the upper surface of the weighted base.

* * * * *